US007019762B2

(12) United States Patent
Yoshihara et al.

(10) Patent No.: US 7,019,762 B2
(45) Date of Patent: Mar. 28, 2006

(54) DISPLAY DEVICE

(75) Inventors: Toshiaki Yoshihara, Kawasaki (JP); Tetsuya Makino, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 401 days.

(21) Appl. No.: 10/375,750

(22) Filed: Feb. 26, 2003

(65) Prior Publication Data

US 2003/0231160 A1 Dec. 18, 2003

(30) Foreign Application Priority Data

Jun. 13, 2002 (JP) ..... 2002-173270

(51) Int. Cl.
*G09G 5/10* (2006.01)

(52) U.S. Cl. ..... 345/690; 345/102; 345/207; 349/68; 349/69

(58) Field of Classification Search ..... 345/87, 345/96, 102, 209, 207, 690, 211–214; 349/68, 349/69

See application file for complete search history.

(56) References Cited

U.S. PATENT DOCUMENTS

| | | | | |
|---|---|---|---|---|
| 5,428,265 | A * | 6/1995 | Booth et al. | 315/158 |
| 6,573,882 | B1 * | 6/2003 | Takabayashi | 345/102 |
| 6,597,348 | B1 * | 7/2003 | Yamazaki et al. | 345/175 |
| 6,809,718 | B1 * | 10/2004 | Wei et al. | 345/102 |
| 6,816,141 | B1 * | 11/2004 | Fergason | 345/88 |
| 2001/0028335 | A1 | 10/2001 | Hasegawa et al. | |
| 2003/0063062 | A1 * | 4/2003 | Tsumura et al. | 345/102 |

FOREIGN PATENT DOCUMENTS

| | | |
|---|---|---|
| CN | 299949 | 3/1997 |
| CN | 375731 | 12/1999 |
| CN | 1293521 | 5/2001 |
| WO | WO 01/26085 | 4/2001 |

* cited by examiner

*Primary Examiner*—Henry N. Tran
(74) *Attorney, Agent, or Firm*—Greer, Burns & Crain, Ltd.

(57) ABSTRACT

Color display is performed by adding data of a predetermined level to pixel data of each emission color inputted according to an image to be displayed and synchronizing an input of summed pixel data obtained by the addition with light emission timing of each of emission colors (R, G, B) from a back-light. Switching is performed between color display based on such summed pixel data and color display based on the original pixel data, according to ambient illuminance measured. Moreover, the predetermined level to be added is suitably selected based on ambient illuminace.

17 Claims, 9 Drawing Sheets

LIGHT-EMISSION OF BACK-LIGHT
ONE FRAME (1/60 sec.)
R-SF (1/180 sec.)
G-SF (1/180 sec.)
B-SF (1/180 sec.)
R
G
B SCAN OF LIQUID CRYSTAL PANEL
1st LINE
L-th LINE
DATA-WRITING SCANNING (1st)
DATA-ERASING SCANNING (2nd)

COLORING OF LIQUID CRYSTAL PANEL
1st LINE
L-th LINE
R
G
B
R
TIME
SF : SUB-FRAME

INPUTTED PIXEL DATA

PIXEL DATA AFTER CONVERTING NUMBER OF GRADATIONS

SUMMED PIXEL DATA OBTAINED BY ADDING WHITE DATA OF 50 GRADATIONS

INPUTTED PIXEL DATA

SUMMED PIXEL DATA OBTAINED BY ADDING WHITE DATA OF 50 GRADATIONS EXCEPT FOR BLACK

SUMMED PIXEL DATA OBTAINED BY
ADDING WHITE DATA OF 50 GRADATIONS
EXCEPT FOR BLACK

DISPLAY DEVICE

BACKGROUND OF THE INVENTION

The present invention relates to a field-sequential type display device for performing color display by synchronizing the light emission timing of each emission color with the input of pixel data corresponding to each emission color.

Along with the recent development of so-called information-oriented society, electronic apparatuses, such as personal computers and PDA (Personal Digital Assistants), have been widely used. Further, with the spread of such electronic apparatuses, portable apparatuses that can be used in offices as well as outdoors have been used, and there are demands for small-size and light-weight of these apparatuses. Liquid crystal display devices have been widely used as one of the means to satisfy such demands. Liquid crystal display devices not only achieve small-size and light-weight, but also include an indispensable technique in an attempt to achieve low power consumption in portable electronic apparatuses that are driven by batteries.

The liquid crystal display devices are mainly classified into a reflection type and a transmission type. In the reflection type, light rays incident from the front face of a liquid crystal panel are reflected by the rear face of the liquid crystal panel, and an image is visualized by the reflected light; whereas, in the transmission type, an image is visualized by the transmitted light from a light source (back-light) placed on the rear face of the liquid crystal panel. Since the reflection type liquid crystal display devices have poor visibility because the amount of the reflected light varies depending on environmental conditions, transmission type liquid crystal display devices are generally used as display devices of, particularly, personal computers that display multi-color or full-color images.

Regarding color liquid crystal display devices, at present, a TN (Twisted Nematic) type using a switching element such as a TFT (Thin Film Transistor) is widely used. Although this TFT-driven TN type liquid crystal display device has high display quality compared to an STN (Super Twisted Nematic) type, it requires a back-light with high intensity because the light transmittance of the liquid crystal panel is only 4% or so at present. Therefore, a lot of power is consumed by the back-light. Moreover, since color display is realized using color filters, a single pixel needs to be composed of three sub-pixels, and thus a high-resolution display is difficult to achieve and the purity of the display colors is not sufficient.

In order to solve such problems, the present inventor et al. developed a field-sequential type liquid crystal display device that displays a color image by using, as a liquid crystal element, a ferroelectric liquid crystal element or an anti-ferroelectric liquid crystal element which responds at high speed to an applied electric field and by causing a single pixel to emit lights of three primary colors in a time-divided manner.

Such a liquid crystal display device realizes color display by combining a liquid crystal panel using a ferroelectric liquid crystal or anti-ferroelectric liquid crystal having a high response speed of several hundreds to several μs order with a back-light capable of emitting red, green and blue lights in a time-divided manner, and synchronizing the switching of a liquid crystal element with a light emission of the back-light.

Since a field-sequential type display device as described above does not require sub-pixels, it is possible to easily realize more resolvable display compared to a color-filter type liquid crystal display device. Moreover, since this display device can use the light emission of a light source as it is for display without using color filters, it has the advantages of high brightness, excellent display color purity, high light utilization efficiency, low power consumption, etc.

However, it is difficult to use a field-sequential type display device as a reflective type/transreflective type display device like a color-filter type display device. When a field-sequential type display device is used in a portable apparatus designed for indoor and outdoor use, there is a visibility problem in outdoor use.

BRIEF SUMMARY OF THE INVENTION

The present invention has been made with the aim of solving the above problems, and it is an object of the present invention to provide a field-sequential type display device capable of improving visibility in outdoor use.

A display device according to the first aspect is a field-sequential type display device for performing color display by switching a plurality of emission colors of a light source with passage of time and synchronizing light emission timing of each emission color with an input of pixel data of each emission color corresponding to an image to be displayed, and comprises: adding means for creating summed pixel data by adding addition data to pixel data of each emission color inputted according to the image to be displayed; and means for receiving an input of the summed pixel data from said adding means and performing color display by synchronizing the light emission timing of each emission color with the input of the summed pixel data.

In the first aspect, color display is performed by adding data of a predetermined level to pixel data of each emission color inputted according to an image to be displayed and synchronizing an input of summed pixel data obtained by the addition with the light emission timing of each of emission colors (R, G, B). By adding the data of the predetermined level to the pixel data of each emission color so as to increase the screen brightness, visibility is improved even in environments with high illuminance, such as outdoors. In this case, the same sub-frames as the sub-frames of the three colors of R, G, B are used, and it is not necessary to change the sub-frames to, for example, sub-frames of R, G, B, W (white) nor change the drive sequence. Thus, an improvement in visibility is easily achieved by only changing the pixel data for display.

A display device according to the second aspect is based on the first aspect, and comprises switching means for performing switching between color display performed based on the pixel data inputted according to the image to be displayed and color display performed based on the summed pixel data obtained by the adding means.

In the second aspect, switching is performed between color display based on the summed pixel data obtained by adding data of a predetermined level to the pixel data of each emission color inputted according to the image to be displayed and color display based on the pixel data of each emission color inputted according to the image to be displayed. It is thus possible to convert the pixel data only when there is a need to increase the visibility, and display the image with high color purity when the visibility is sufficient.

A display device according to the third aspect is based on the second aspect, and comprises: measuring means for measuring ambient illuminance; and means for controlling switching performed by the switching means, based on a result of measurement obtained by the measuring means.

In the third aspect, switching in the second aspect is performed based on ambient illuminance. It is therefore possible to easily adjust the balance between the improvement in visibility and the purity of display colors, according to a need.

A display device according to the fourth aspect is based on the first or second aspect, and comprises: storage means for storing a plurality of kinds of data of mutually different levels for use as addition data; and selecting means for selecting one kind of data from the plurality of kinds of data stored in the storage means.

In the fourth aspect, data of a plurality of levels are present as the data to be added to the pixel data of each emission color inputted according to the image to be displayed, and data of one level among the plurality of levels is selected and added to the pixel data of each emission color to be inputted. It is therefore possible to suitably select a level of data to be added and easily adjust the balance between the improvement of visibility and the purity of display colors.

A display device according to the fifth aspect is based on the fourth aspect, and comprises: measuring means for measuring ambient illuminance; and means for controlling selection performed by the selecting means, based on a result of measurement obtained by the measuring means.

In the fifth aspect, a level of data to be added in the fourth aspect is selected based on ambient illuminance. It is therefore possible to easily adjust the balance between the improvement of visibility and the purity of display colors, according to a need.

A display device according to the sixth aspect is based on any one of the first through fifth aspects, wherein the addition data is substantially white achromatic data.

In the sixth aspect, data to be added to the pixel data of each emission color inputted according to the image to be displayed is substantially white achromatic data. It is therefore possible to prevent a big change in the display colors due to the addition of data.

A display device according to the seventh aspect is based on any one of the first through sixth aspects, and comprises means for controlling intensities of the plurality of emission colors of the light source.

In the seventh aspect, by increasing the intensities of the plurality of emission colors according to a need, it is possible to improve the brightness during white display and achieve a further improvement in visibility.

A display device according to the eighth aspect is based on any one of the first through seventh aspects, and comprises means for creating converted pixel data by converting the inputted pixel data, according to the addition data, wherein the addition data is added to the converted pixel data by the adding means.

In the eighth aspect, the level of the pixel data of each emission color inputted according to the image to be displayed is converted, and the addition data is added to the converted pixel data so that pixel data after the addition does not exceed a maximum number of gradations. Consequently, white-out of the display does not occur, and the visibility is increased.

A display device according to the ninth aspect is based on any one of the first through eighth aspects, and comprises means for detecting whether a level of the pixel data to be inputted is not more than a predetermined level, wherein, when the level of the inputted pixel data is not more than the predetermined level, addition of the addition data is not performed by the adding means.

In the ninth aspect, when the level of pixel data inputted according to the image to be displayed is not more than the predetermined level, for example, when the pixel data is black display, data addition is not performed. Hence, it is possible to maintain the display with high black/white contrast and achieve an improvement in visibility.

The above and further objects and features of the invention will more fully be apparent from the following detailed description with accompanying drawings.

DETAILED DESCRIPTION OF THE INVENTION

The following description will specifically explain the present invention with reference to the drawings illustrating some embodiments thereof. It should be noted that the present invention is not limited to the following embodiments.

Figure 1:
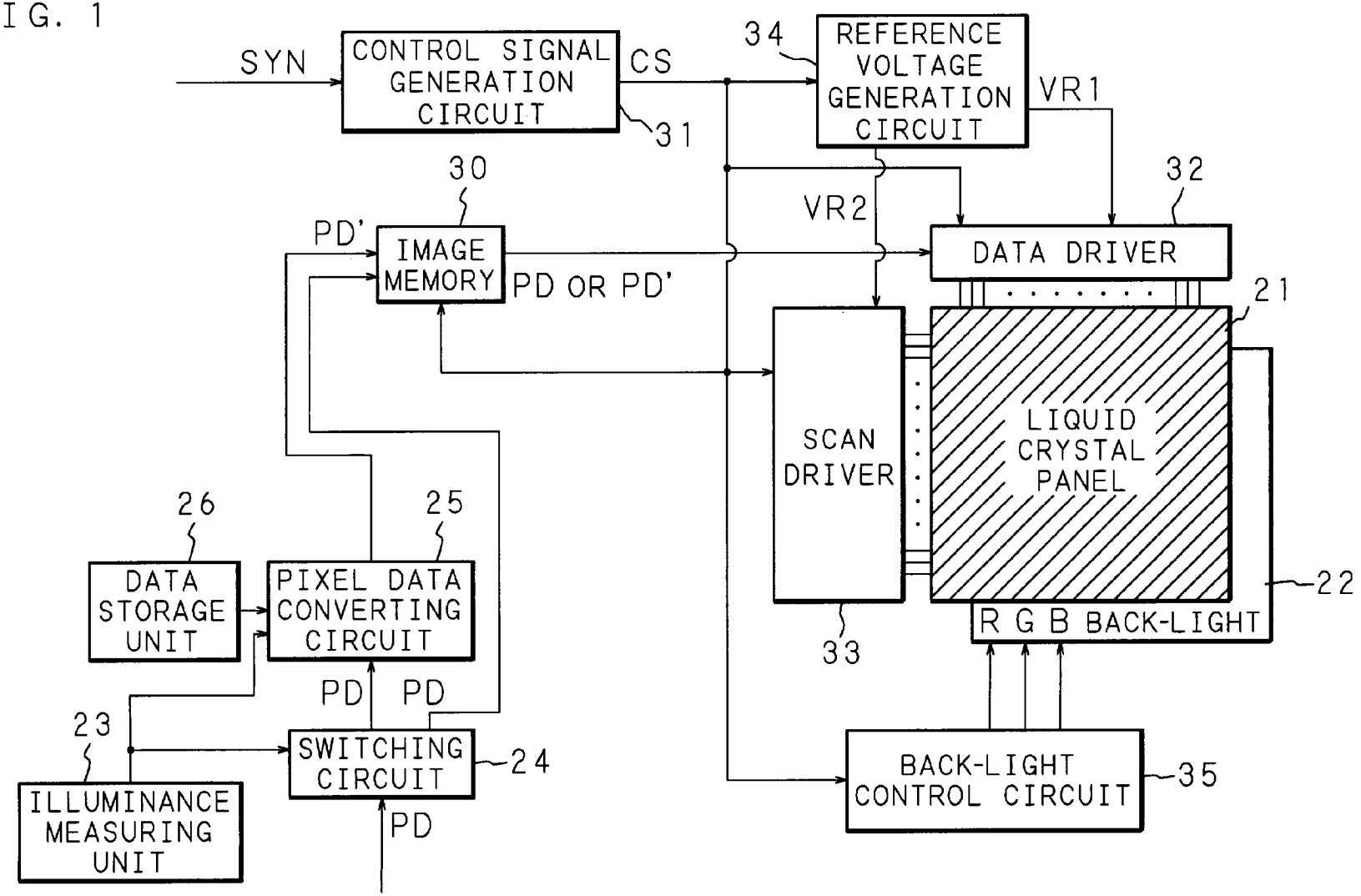
FIG. 1 is a block diagram showing the circuit structure of a liquid crystal display device of the present invention.
Figure 2:
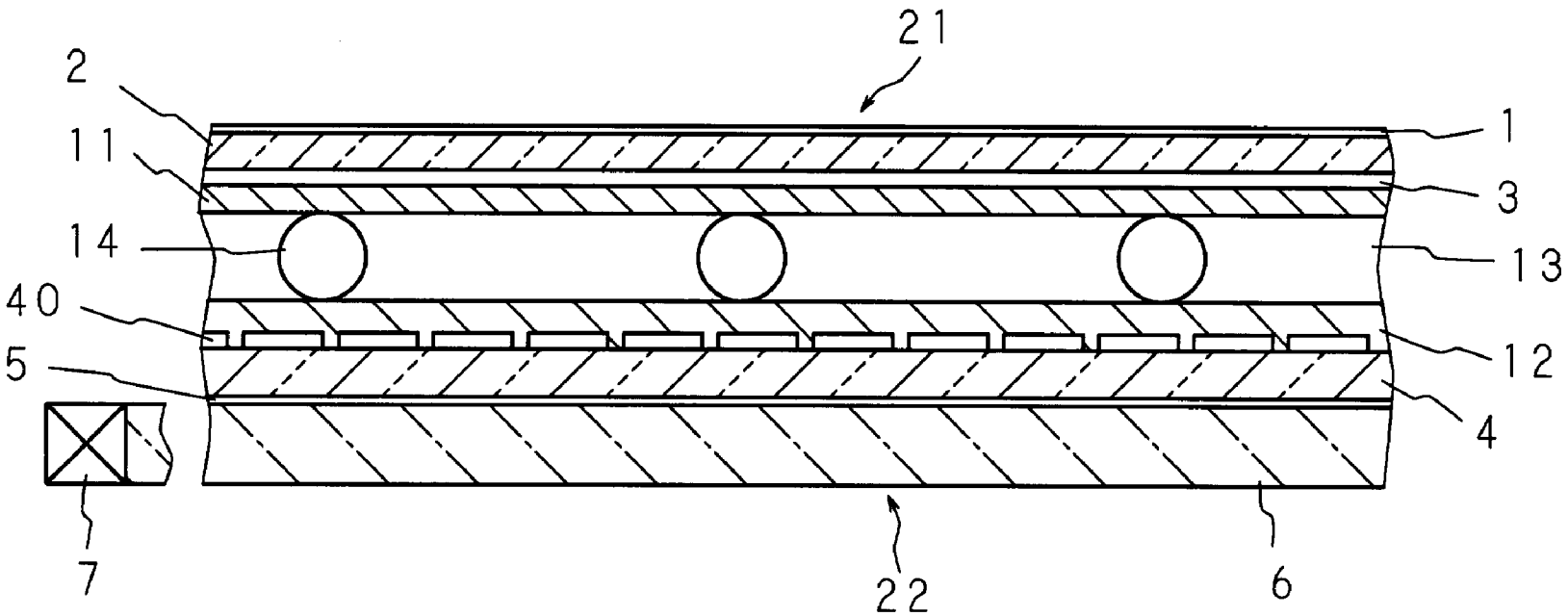
FIG. 2 is a schematic cross sectional view of a liquid crystal panel and a back-light.
Figure 3:
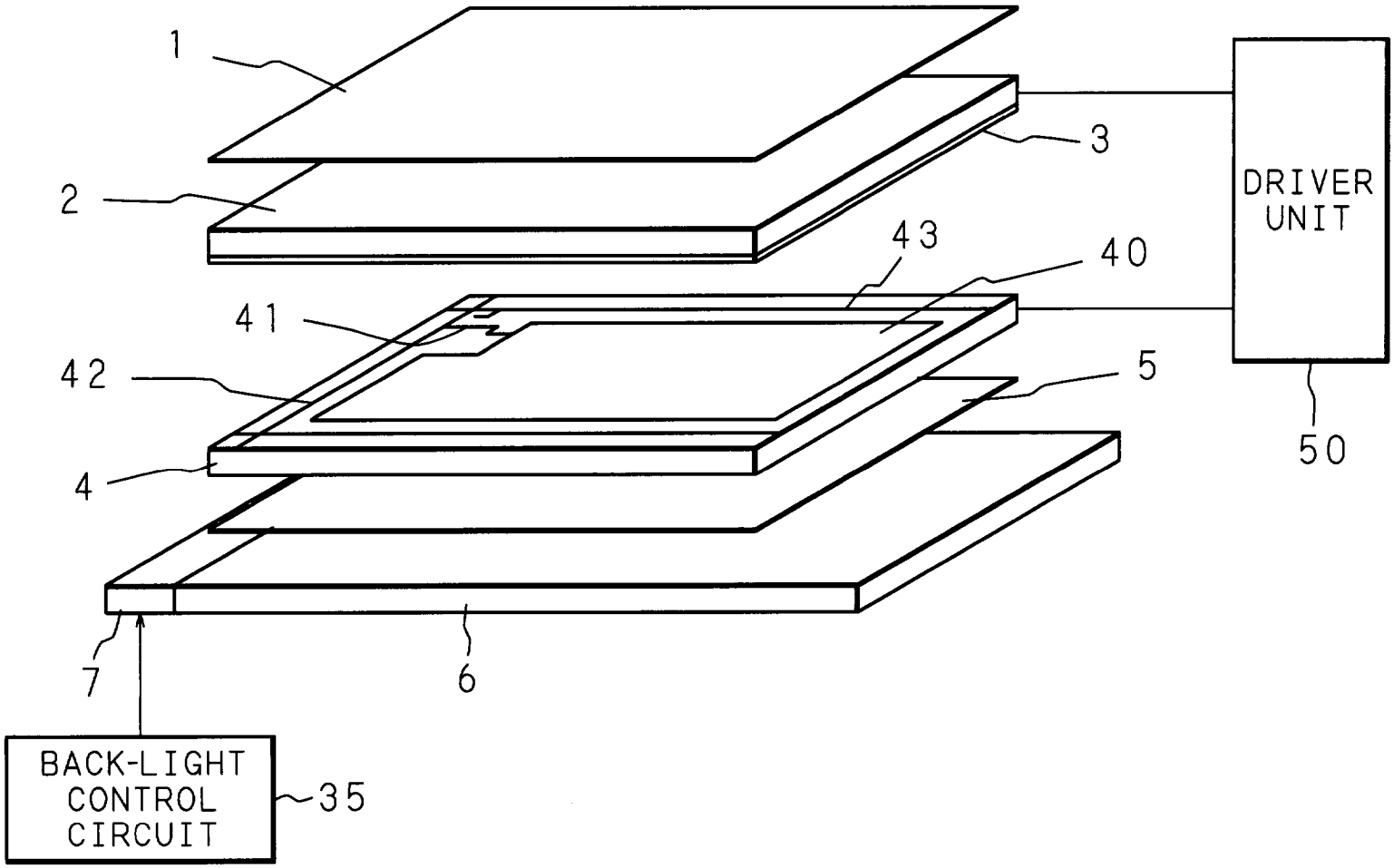
FIG. 3 is a schematic view showing an example of the overall structure of the liquid crystal display device.
Figure 4:
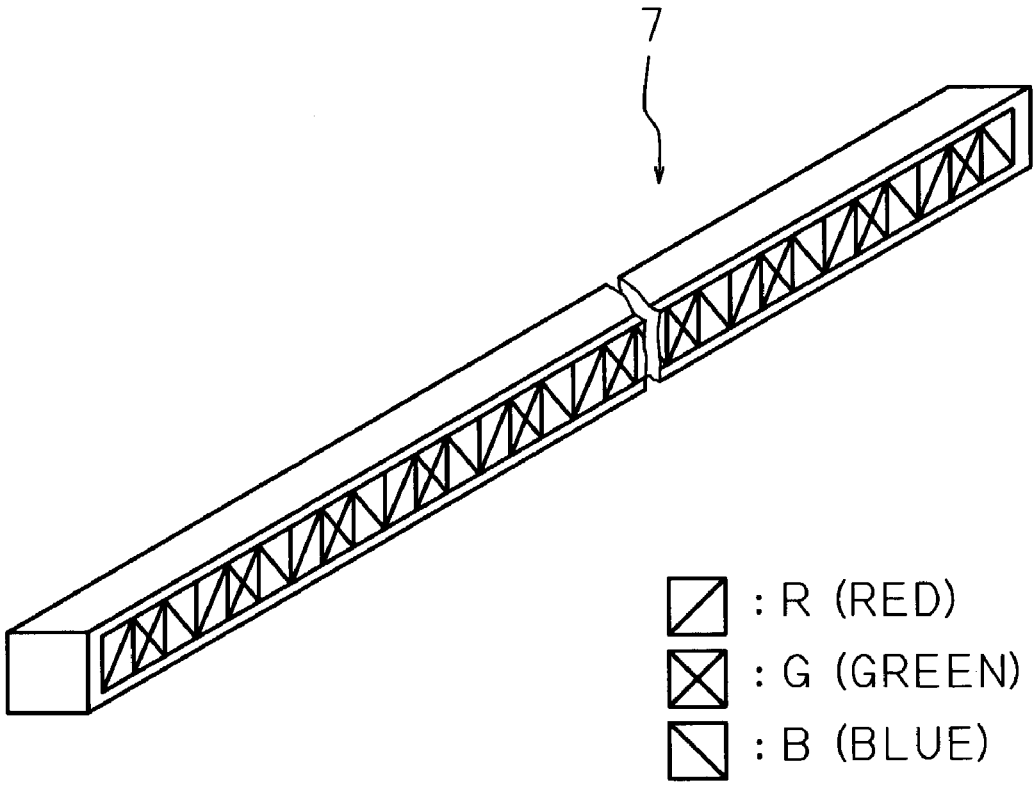
FIG. 4 is an illustration showing an example of the structure of an LED array.

FIG. 1 is a block diagram showing the circuit structure of a liquid crystal display device of the present invention; FIG. 2 is a schematic cross sectional view of a liquid crystal panel and a back-light of the liquid crystal display device; FIG. 3 is a schematic view showing an example of the overall structure of the liquid crystal display device; and FIG. 4 is an illustration showing an example of the structure of an LED array that is a light source of the back-light.

In FIG. 1, the reference numerals 21 and 22 respectively represent the liquid crystal panel and back-light whose cross sectional structures are shown in FIG. 2. As shown in FIG. 2, the back-light 22 is composed of an LED array 7 for emitting light of each of red, green and blue colors, and a light guiding and diffusing plate 6.

As shown in FIG. 2 and FIG. 3, the liquid crystal panel 21 comprises a polarizer 1, a glass substrate 2, a common electrode 3, a glass substrate 4 and a polarizer 5, which are stacked in this order from the upper layer (front face) side to the lower layer (rear face) side, and pixel electrodes 40 which are arranged in matrix form on a surface of the glass substrate 4, facing the common electrode 3.

A driver unit 50 comprising later-described data driver 32 and scan driver 33 is connected between the common electrode 3 and the pixel electrodes 40. The data driver 32 is connected to TFTs (Thin Film Transistors) 41 through signal lines 42, while the scan driver 33 is connected to the TFTs 41 through scanning lines 43. The TFTs 41 are controlled to be on/off by the data driver 32 and scan driver 33. Each of pixel electrodes 40 is connected to the TFT 41. Therefore, the intensity of transmitted light of each pixel is controlled by a signal given from the data driver 32 through the signal line 42 and the TFT 41.

An alignment film 12 is provided on the upper face of the pixel electrodes 40 on the glass substrate 4, while an alignment film 11 is placed on the lower face of the common electrode 3. The space between these alignment films 11 and 12 is filled with a liquid crystal material so as to form a liquid crystal layer 13. Note that the reference numeral 14 represents spacers for maintaining a layer thickness of the liquid crystal layer 13.

The back-light 22 is disposed on the lower layer (rear face) side of the liquid crystal panel 21, and comprises the LED array 7 which is placed to face an end face of the light guiding and diffusing plate 6, which forms a light emitting area. As shown in FIG. 4, this LED array 7 includes LEDs for emitting lights of three primary colors, namely red (R), green (G) and blue (B), the LEDs being arranged sequentially and repeatedly on a surface facing the light guiding and diffusing plate 6. Then, the red, green and blue LEDs are controlled to emit light in red, green and blue sub-frames, respectively. The light guiding and diffusing plate 6 guides the light emitted from each LED of this LED array 7 to its entire surface and diffuses it to the upper face, thereby functioning as the light emitting area.

This liquid crystal panel 21 is combined with the back-light 22 capable of emitting red, green and blue lights in a time-divided manner. The light emission timing and emission color of this back-light 22 are controlled in synchronism with data writing/erasing scanning of the liquid crystal panel 21.

In FIG. 1, the reference numeral 23 represents an illuminance measuring unit for measuring the brightness outside the liquid crystal display device (the ambient illuminance near the display section), and the illuminance measuring unit 23 outputs the result of measuring the illuminance to a switching circuit 24 and a pixel data converting circuit 25. When the switching circuit 24 is caused to receive an input of pixel data PD for display from an external device, for example, a personal computer, and is set to perform addition of data (the process of adding data to the pixel data PD as to be described later), which is a characteristic of the present invention, it outputs the inputted pixel data PD to the pixel data converting circuit 25. Whereas, when the switching circuit 24 is not set to perform addition of data, it outputs the inputted pixel data PD as it is to an image memory 30. This switching between performing and not performing data addition is controlled based on the result of measuring the illuminance, given from the illuminance measuring unit 23.

The pixel data converting circuit 25 converts the inputted pixel data PD of each of red, green and blue colors into pixel data PD' (summed pixel data) by adding data of a predetermined level to the inputted pixel data PD, according to later-described various methods, and outputs the converted pixel data PD' to the image memory 30. More specifically, the pixel data converting circuit 25 selects one kind of addition data from a data storage unit 26 storing various kinds of data of different levels (gradation number) for use as data to be added, adds the selected addition data to the inputted pixel data PD to obtain pixel data PD', and then outputs the obtained pixel data PD' to the image memory 30. A decision of making which level (gradation number) of addition data is to be selected is controlled based of the result of measuring the illuminance, given from the illuminance measuring unit 23.

The reference numeral 31 is a control signal generation circuit which is supplied with a synchronous signal SYN from the personal computer and generates various control signals CS necessary for display. The pixel data PD or PD' is outputted from the image memory 30 to the data driver 32. Based on the pixel data PD or PD' and a control signal CS for changing the polarity of applied voltage, substantially equal voltages with different polarities are applied to the liquid crystal panel 21 through the data driver 32 during data-writing scanning and data-erasing scanning, respectively.

Moreover, the control signal generation circuit 31 outputs a control signal CS to each of a reference voltage generation circuit 34, the data driver 32, the scan driver 33, and a back-light control circuit 35. The reference voltage generation circuit 34 generates reference voltages VR1 and VR2, and outputs the generated reference voltages VR1 and VR2 to the data driver 32 and the scan driver 33, respectively. The data driver 32 outputs signals to the signal lines 42 of the pixel electrodes 40, based on the pixel data PD or PD' and the control signal CS. In synchronism with the output of the signals, the scan driver 33 scans the scanning lines 43 of the pixel electrodes 40 sequentially on a line by line basis. Furthermore, the back-light control circuit 35 applies a drive voltage to the back-light 22 so that each of the red, green and blue LEDs of the LED array 7 of the back-light 22 emits light in a time-divided manner.

Next, the operation of the liquid crystal display device of the present invention will be explained. Pixel data PD for display is inputted into the switching circuit 24 from the personal computer. When it is found from the result of the measurement by the illuminance measuring unit 23 that ambient illuminance is lower than a predetermined value, the pixel data PD inputted into the switching circuit 24 is sent to the image memory 30. On the other hand, when ambient illuminance is higher than the predetermined value, the pixel data PD inputted into the switching circuit 24 is sent to the pixel data converting circuit 25, and addition of data is performed.

In other words, in the pixel data converting circuit 25, data of a predetermined level (gradations) selected based on ambient illuminance is added to the inputted pixel data PD, and pixel data PD' is obtained by this addition. The pixel data PD' is sent to the image memory 30. However, if the inputted pixel data is black display, the addition of data is not performed by the pixel data converting circuit 25. Note that the specific content of this data addition process will be described in detail later.

After storing the pixel data PD or PD' temporarily, the image memory 30 outputs the pixel data PD or PD' upon receipt of the control signal CS outputted from the control signal generation circuit 31. The control signal CS generated by the control signal generation circuit 31 is supplied to the data driver 32, scan driver 33, reference voltage generation circuit 34 and back-light control circuit 35. The reference voltage generation circuit 34 generates reference voltages VR1 and VR2 upon receipt of the control signal CS, and outputs the generated reference voltages VR1 and VR2 to the data driver 32 and the scan driver 33, respectively.

When the data driver 32 receives the control signal CS, it outputs a signal to the signal lines 42 of the pixel electrodes 40, based on the pixel data PD or PD' outputted from the image memory 30. When the scan driver 33 receives the control signal CS, it scans the scanning lines 43 of the pixel electrodes 40 sequentially on a line by line basis. According to the output of the signal from the data driver 32 and the scanning by the scan driver 33, the TFTs 41 are driven and a voltage is applied to the pixel electrodes 40, thereby controlling the intensity of the transmitted light of the pixels.

When the back-light control circuit 35 receives the control signal CS, it applies a drive voltage to the back-light 22 so that each of the red, green and blue LEDs of the LED array 7 of the back-light 22 emits light in a time-divided manner, thereby emitting red light, green light and blue light sequentially with passage of time.

Figures 5A, 5B, 5C:
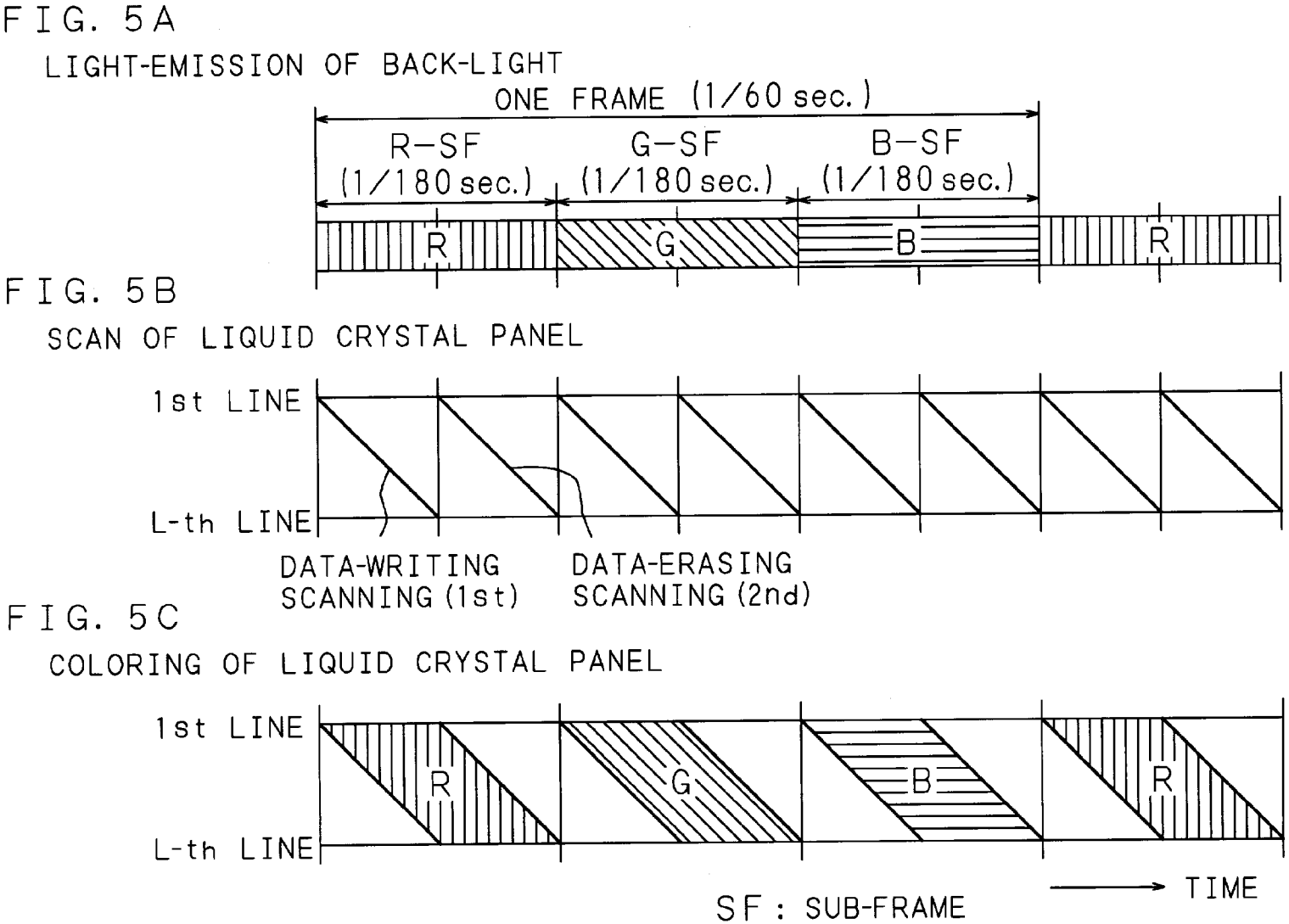
FIGS. 5A through 5C are time charts showing display control in the liquid crystal display device of the present invention.

FIGS. 5A through 5C are time charts showing display control in the liquid crystal display device of the present invention, and FIG. 5A shows the light-emission timing of each of red, green and blue colors of the back-light 22 (LED); FIG. 5B shows the scanning timing of each line in the liquid crystal panel 21; and FIG. 5C shows the coloring state of the liquid crystal panel 21. One frame is divided into three sub-frames, and, as shown in FIG. 5A, red light, green light and blue light are emitted in the first sub-frame, the second sub-frame and the third sub-frame, respectively.

Meanwhile, as shown in FIG. 5B, with respect to the liquid crystal panel 21, data scanning is performed twice in each of the red, green and blue sub-frames. However, the timing is adjusted so that the first scanning (data-writing scanning) start timing (timing to the first line) coincides with the start timing of each sub-frame, and the second scanning (data-erasing scanning) start timing (timing to the first line) coincides with the halftime of each sub-frame. During the data-writing scanning, a voltage corresponding to the pixel data is supplied to each pixel of the liquid crystal panel 21, and the light transmittance is adjusted. Accordingly, it is possible to achieve a full-color display. Moreover, during the data-erasing scanning, a voltage which has the same magnitude but has an opposite polarity to the voltage in the data-writing scanning is supplied to each pixel of the liquid crystal panel 21, the display of each pixel of the liquid crystal panel 21 is made substantially black, and further the application of a direct-current component to the liquid crystal is prevented.

Here, in the present invention, data of the selected number of gradations is added to the inputted original pixel data of the three colors of red, green and blue, according to a need, so as to convert the original data into summed pixel data of the three colors of red, green and blue, and then a voltage corresponding to the summed pixel data is supplied. For such a data addition process, it is possible to use various methods as described below.

(First Embodiment)

After washing a TFT substrate having pixel electrodes 40 (in matrix form with 640×480 pixels and a diagonal of 3.2 inches) and a glass substrate 2 having a common electrode 3, they were coated with polyimide and then baked for one hour at 200° C. so as to form about 200 Å thick polyimide films as alignment films 11 and 12. Further, these alignment films 11 and 12 were rubbed with a rayon fabric, and then an empty panel was produced by stacking the two substrates with a gap being maintained therebetween by spacers 14 made of silica having an average particle size of 1.4 μm so that the rubbing directions were parallel. A ferroelectric liquid crystal material with spontaneous polarization of 10 $nC/cm^2$ was sealed in between the alignment films 11 and 12 of this empty panel so as to form a liquid crystal layer 13. This sealed ferroelectric liquid crystal material showed a mono-stable characteristic, and the maximum value of the tilt angle was 53° when a voltage of the first polarity was applied, while the maximum value of the tilt angle was 5° when a voltage of the second polarity opposite to the first polarity was applied. A liquid crystal panel 21 was obtained by sandwiching the fabricated panel by two polarizers 1 and 5 arranged in a crossed-Nicol state, and a dark state was produced by causing the average molecular axis of the liquid crystal molecular director in the applied voltage=0(V) to substantially coincide with the polarization axis of one of the polarizers.

The liquid crystal panel 21 thus fabricated was combined with a back-light 22 using, as a light source, an LED array 7 capable of performing single-color surface emission switching for red, green and blue, and then color display was performed by a field-sequential method, according to the drive sequence shown in FIGS. 5A through 5C.

Figure 6A:
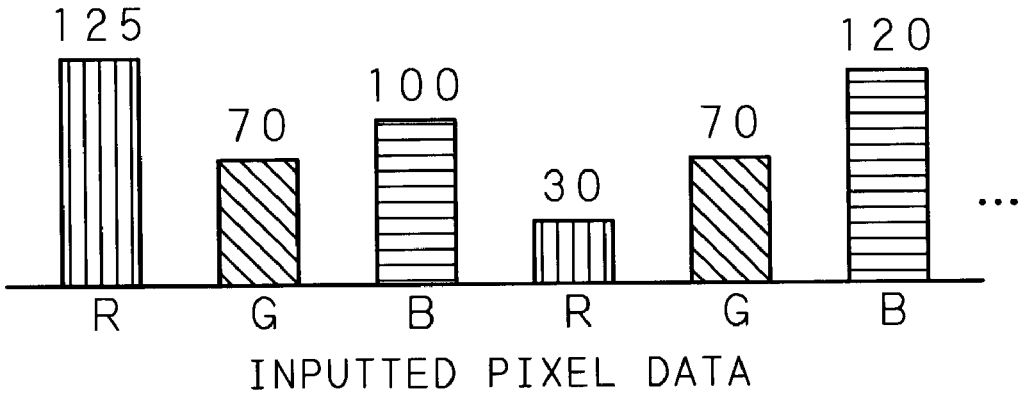
FIGS. 6A and 6B are illustrations showing one example (the first through third embodiments) of pixel data conversion performed by the present invention.
Figure 6A:
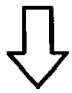
Figure 6B:
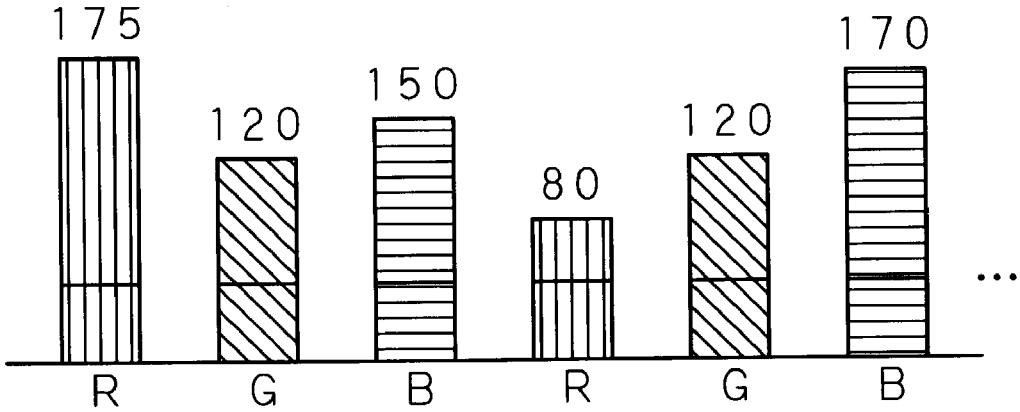

The color display was performed while making a switching between color display based on the summed pixel data obtained by adding data of predetermined gradations to pixel data inputted according to an image to be displayed and color display based on the pixel data inputted according to the image to be displayed, in accordance with the result of measuring ambient illuminance by the illuminance measuring unit 23, as shown in FIGS. 6A and 6B. In this example, data of 50 gradations was added to each gradation of R (red), G (green) and B (blue) of the inputted pixel data (maximum: 255 gradations)(FIG. 6A).

First, when display was performed in an indoor environment with an illuminance of 700 lux, high visibility was obtained by both the display based on the summed pixel data obtained by adding data of 50 gradations to the pixel data inputted according to the image to be displayed and the display based on the pixel data inputted according to the image to be displayed. However, the purity of display colors is higher in the latter display than in the former display.

Next, when display was performed in an outdoor environment with an illuminance of 15000 lux, higher visibility was obtained by the display based on the summed pixel data obtained by adding data of 50 gradations to the pixel data inputted according to the image to be displayed than the display based on the pixel data inputted according to the image to be displayed. The latter display enabled only low-visibility display.

(Second Embodiment)

Like the first embodiment, after washing a TFT substrate having pixel electrodes 40 (in matrix form with 640×480 pixels and a diagonal of 3.2 inches) and a glass substrate 2 having a common electrode 3, they were coated with polyimide and then baked for one hour at 200° C. so as to form about 200 Å thick polyimide films as alignment films 11 and 12. Further, these alignment films 11 and 12 were rubbed with a rayon fabric, and then an empty panel was fabricated by stacking the two substrates with a gap being maintained therebetween by spacers 14 made of silica having an average particle size of 1.4 μm so that the rubbing directions were parallel. A ferroelectric liquid crystal material with spontaneous polarization of 8 $nC/cm^2$ and a bi-stable characteristic was sealed in between the alignment films 11 and 12 of this empty panel so as to form a liquid crystal layer 13. A liquid crystal panel 21 was obtained by sandwiching the fabricated panel by two polarizers 1 and 5 arranged in a crossed-Nicol state, and a dark state was produced by causing the average molecular axis of the liquid crystal molecular director when a voltage with one polarity was applied to substantially coincide with the polarization axis of one of the polarizers.

The thus fabricated liquid crystal panel 21 was combined with the back-light 22 using, as a light source, the LED array 7 capable of performing single-color surface emission switching for red, green and blue, and then color display was performed by a field-sequential method, according to the drive sequence shown in FIGS. 5A through 5C.

Then, color display was performed based on the summed pixel data obtained by adding data of predetermined gradations to pixel data inputted according to the image to be displayed. In this example, data of 50 gradations, data of 75 gradations, and data of 100 gradations were respectively added to each gradation of the inputted pixel data of R (red), G (green) and B (blue).

First, when display was performed in an outdoor environment with an illuminance of 15000 lux so as to evaluate visibility by eyes, the image displayed based on the data obtained by adding data of 75 gradations to each of R (red), G (green) and B (blue) was most easily seen. Next, when display was performed in an outdoor environment with an illuminance of 20000 lux so as to evaluate visibility by eyes, the image displayed based on the data obtained by adding data of 100 gradations to each of R (red), G (green) and B (blue) was most easily seen.

Hence, it can be understood from the above-mentioned results that it is possible to improve visibility by selecting data of optimum gradations for addition, based on the result of measuring ambient illuminance with the illuminance measuring unit 23 and performing color display, based on summed pixel data obtained by adding the data of gradations thus selected to the pixel data inputted according to the image to be displayed, (Third Embodiment)

Like the first embodiment, after washing a TFT substrate having pixel electrodes 40 (in matrix form with 640×480 pixels and a diagonal of 3.2 inches) and a glass substrate 2 having a common electrode 3, they were coated with polyimide and then baked for one hour at 200° C. so as to form about 200 Å thick polyimide films as alignment films 11 and 12. Further, these alignment films 11 and 12 were rubbed with a rayon fabric, and then an empty panel was fabricated by stacking the two substrates with a gap being maintained therebetween by spacers 14 made of silica having an average particle size of 1.4 μm so that the rubbing directions were parallel. A ferroelectric liquid crystal material with spontaneous polarization of 15 nC/cm$^2$ and a bi-stable characteristic was sealed in between the alignment films 11 and 12 of this empty panel so as to form a liquid crystal layer 13. A liquid crystal panel 21 was obtained by sandwiching the fabricated panel by two polarizers 1 and 5 arranged in a crossed-Nicol state, and a dark state was produced by causing the average molecular axis of the liquid crystal molecular director when a voltage with one polarity was applied to substantially coincide with the polarization axis of one of the polarizers.

The thus fabricated liquid crystal panel 21 was combined with the back-light 22 using, as a light source, the LED array 7 capable of performing single-color surface emission switching for red, green and blue, and then color display was performed by a field-sequential method, according to the drive sequence shown in FIGS. 5A through 5C.

Then, color display was performed based on the summed pixel data obtained by adding data of 50 gradations to each gradation of R (red), G (green) and B (blue) of pixel data inputted according to the image to be displayed. Additionally, the brightness of the back-light 22 was increased by twice temporarily.

It was found by examining the display characteristic in an outdoor environment with an illuminance of 20000 lux that the visibility and purity of display colors of this embodiment were both superior to those of the image displayed based on the summed pixel data obtained by adding data of 100 gradations in the second embodiment.

(Fourth Embodiment)

Like the first embodiment, after washing a TFT substrate having pixel electrodes 40 (in matrix form with 640×480 pixels and a diagonal of 3.2 inches) and a glass substrate 2 having a common electrode 3, they were coated with polyimide and then baked for one hour at 200° C. so as to form about 200 Å thick polyimide films as alignment films 11 and 12. Further, these alignment films 11 and 12 were rubbed with a rayon fabric, and then an empty panel was fabricated by stacking the two substrates with a gap being maintained therebetween by spacers 14 made of silica having an average particle size of 1.4 μm so that the rubbing directions were parallel. A ferroelectric liquid crystal material with spontaneous polarization of 15 nC/cm$^2$ was sealed in between the alignment films 11 and 12 of this empty panel so as to form a liquid crystal layer 13. The sealed ferroelectric liquid crystal material showed a mono-stable characteristic, and the maximum value of the tilt angle was 58° when a voltage of the first polarity was applied, while the maximum value of the tilt angle was 5° when a voltage of the second polarity was applied. A liquid crystal panel 21 was obtained by sandwiching the fabricated panel by two polarizers 1 and 5 arranged in a crossed-Nicol state, and a dark state was produced by causing the average molecular axis of the liquid crystal molecular director in the applied voltage=0(V) to substantially coincide with the polarization axis of one of the polarizers.

The thus fabricated liquid crystal panel 21 was combined with the back-light 22 using, as a light source, the LED array 7 capable of performing single-color surface emission switching for red, green and blue, and then color display was performed by a field-sequential method, according to the drive sequence shown in FIGS. 5A through 5C.

Figure 7A:
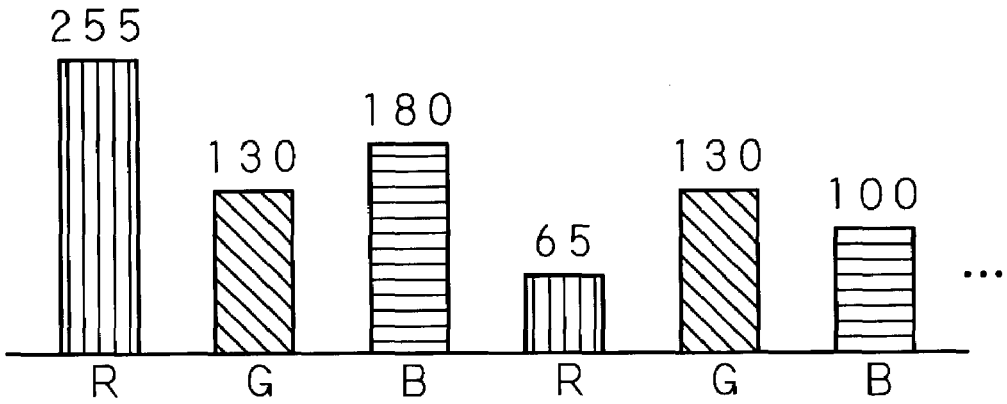
FIGS. 7A through 7C are illustrations showing another example (the fourth embodiment) of pixel data conversion performed by the present invention.
Figure 7B:
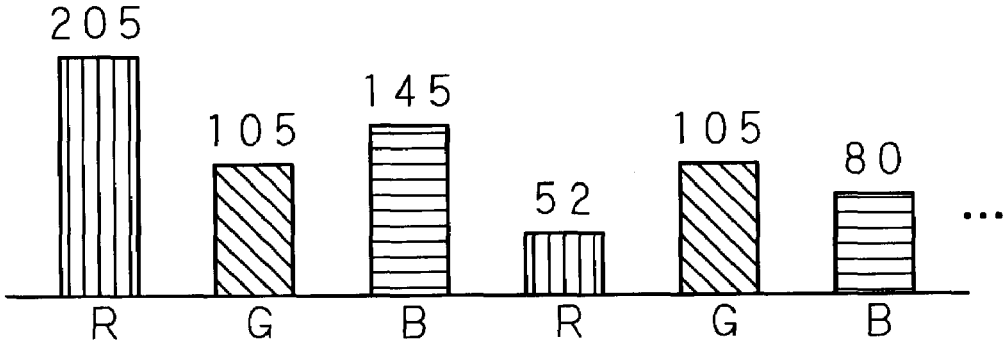
Figure 7C:
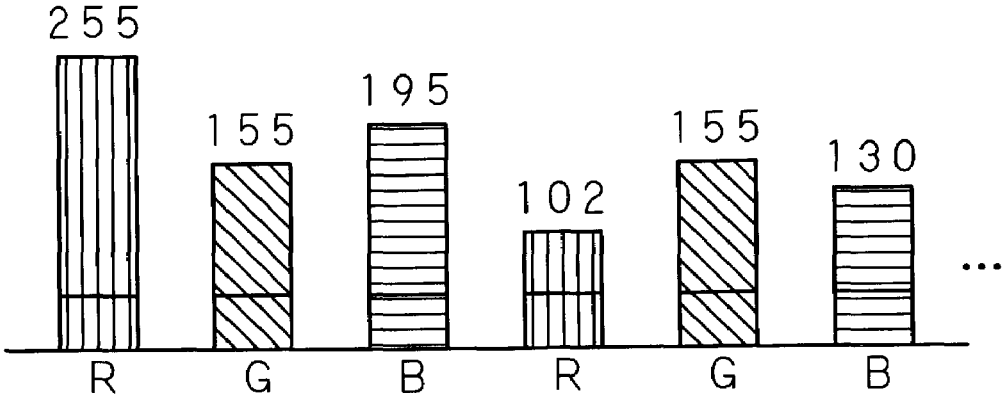

Like the first embodiment, color display was performed while making a switching between color display based on the summed pixel data obtained by adding data of predetermined gradations to pixel data inputted according to the image to be displayed and color display based on the pixel data inputted according to the image to be displayed, in accordance with the result of measuring ambient illuminance with the illuminance measuring unit 23, and the data to be added to each gradation of R (red), G (green) and B (blue) was data of 50 gradations. In this example, however, as shown in FIGS. 7A through 7C, before adding the data of 50 gradations, the pixel data (FIG. 7A) inputted according to the image to be displayed was multiplied by 205/255 (FIG. 7B), and color display was performed based on summed pixel data obtained by adding the data of 50 gradations to the result of the multiplication (FIG. 7C). Consequently, in this example, even when the data of 50 gradations was added, the pixel data after the addition does not exceed a maximum number of gradations (255 gradations), thereby preventing white-out of the display.

First, when display was performed in an indoor environment with an illuminance of 700 lux, high visibility was achieved by both the display based on the summed pixel data obtained by multiplying the pixel data inputted according to the image to be displayed by 205/255 and then adding data of 50 gradations to the multiplied pixel data, and the display based on the pixel data inputted according to the image to be displayed. Moreover, in the former display, since white-out of the display did not occur, the display characteristic was improved as compared to the first embodiment.

Next, when display was performed in an outdoor environment with an illuminance of 15000 lux, higher visibility was achieved by the display based on the summed pixel data obtained by multiplying the pixel data inputted according to the image to be displayed by 205/255 and then adding data of 50 gradations to the multiplied pixel data than the display based on the pixel data inputted according to the image to be displayed.

(Fifth Embodiment)

Like the first embodiment, after washing a TFT substrate having pixel electrodes 40 (in matrix form with 640×480 pixels and a diagonal of 3.2 inches) and a glass substrate 2 having a common electrode 3, they were coated with polyimide and then baked for one hour at 200° C. so as to form about 200 Å thick polyimide films as alignment films 11 and 12. Further, these alignment films 11 and 12 were rubbed with a rayon fabric, and then an empty panel was fabricated by stacking the two substrates with a gap being maintained therebetween by spacers 14 made of silica having an average particle size of 1.4 μm so that the rubbing directions were parallel. A bi-stable ferroelectric liquid crystal material with spontaneous polarization of 15 $nC/cm^2$ was sealed in between the alignment films 11 and 12 of this empty panel so as to form a liquid crystal layer 13. A liquid crystal panel 21 was obtained by sandwiching the fabricated panel by two polarizers 1 and 5 arranged in a crossed-Nicol state, and a dark state was produced by causing the average molecular axis of the liquid crystal molecular director when a voltage with one polarity was applied to substantially coincide with the polarization axis of one of the polarizers.

The thus fabricated liquid crystal panel 21 was combined with the back-light 22 using, as a light source, the LED array 7 capable of performing single-color surface emission switching for red, green and blue, and then color display was performed by a field-sequential method, according to the drive sequence shown in FIGS. 5A through 5C.

FIGS. 8A and 8B and FIGS. 9A through 9C are illustrations showing one example of pixel data conversion performed by the fifth embodiment. A decision is made as to whether the inputted pixel data is black display or not, and, if it is black display, addition of data is not performed, but, if it is not black display, addition of data is performed. For the addition of data, two methods were adopted.

Figure 8A:
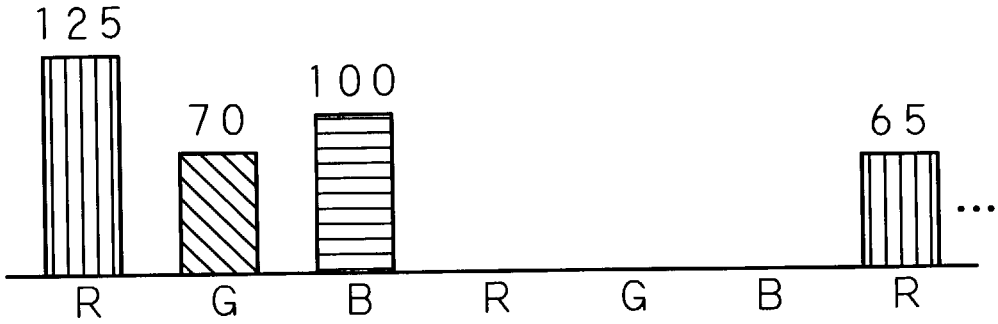
FIGS. 8A and 8B are illustrations showing still another example (the fifth embodiment) of pixel data conversion performed by the present invention.
Figure 8A:
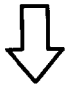
Figure 8B:
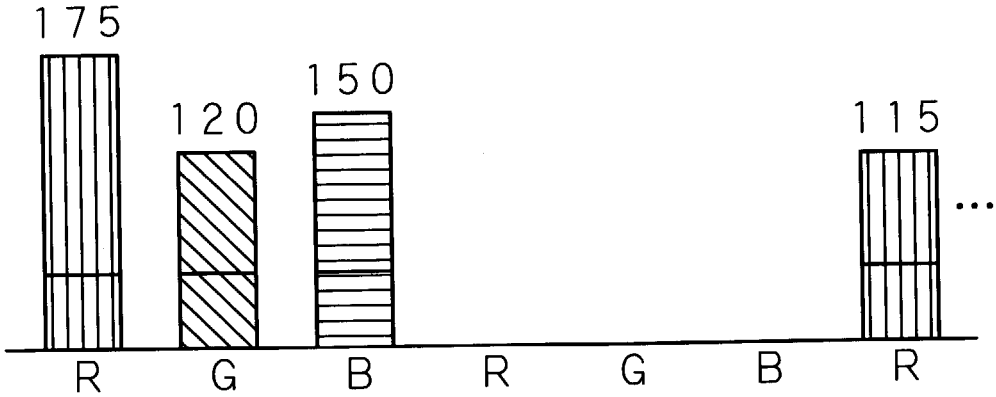
Figure 9A:
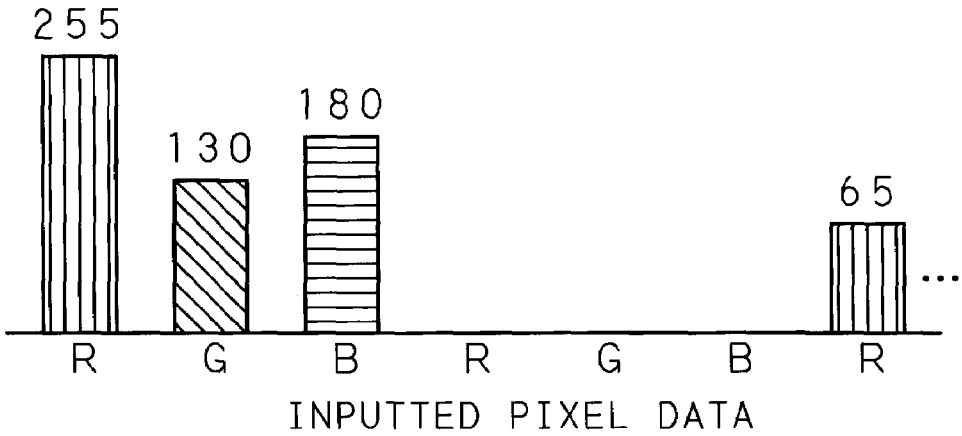
FIGS. 9A through 9C are illustrations showing yet another example (the fifth embodiment) of pixel data conversion performed by the present invention.
Figure 9B:
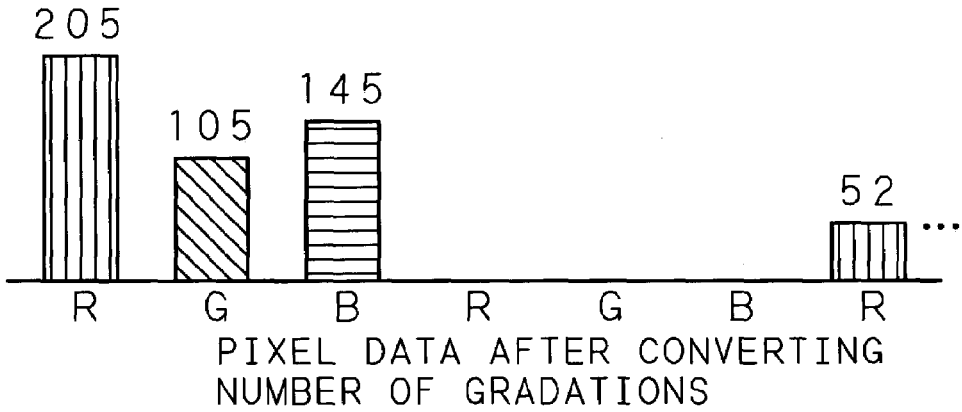
Figure 9C:
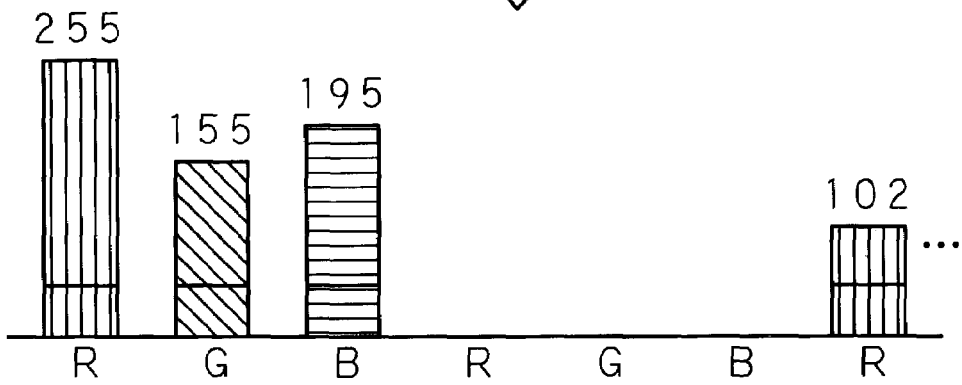

In the example shown in FIGS. 8A and 8B, like the first embodiment, color display was performed based on summed pixel data (FIG. 8B) obtained by adding data of 50 gradations to each gradation of R (red), G (green) and B (blue) pixel data, except for black display, among the inputted pixel data including black display (FIG. 8A). On the other hand, in the example shown in FIGS. 9A through 9C, like the fourth embodiment, before adding the data of 50 gradations, the pixel data including black display inputted according to the image to be displayed (FIG. 9A) was multiplied by 205/255 (FIG. 9B), and color display was performed based on summed pixel data (FIG. 9C) obtained by adding the data of 50 gradations to the results of the multiplication except for black display.

When display was performed in an outdoor environment with an illuminance of 15000 lux, high visibility was achieved by both the display based on the summed pixel data obtained by not adding data for black display but adding data of 50 gradations to the pixel data inputted according to the image to be displayed for display other than black, and the display based on the summed pixel data obtained by not adding data for black display but multiplying the pixel data inputted according to the image to be displayed by 205/255 and then adding data of 50 gradations for display other than black. Moreover, these displays achieved higher visibility compared to the displays of the first through fourth embodiments in which whether the data is to be added or not is not controlled based on whether the data pixel is black display or not.

Note that, in the above-described fifth embodiment, the addition of data is not performed only when the pixel data is black display, but similar effects are also obtained by detecting display with gradations less than a predetermined number of gradations (a predetermined level) and not performing the addition of data for the pixel data of the detected display. In this case, the predetermined number of gradations (the predetermined level) for deciding whether to perform the addition of data is suitably selected according to environmental conditions such as ambient illuminance.

Moreover, in the above-described example, a ferroelectric liquid crystal material was used, but it is, of course, possible to apply the present invention in the same manner to a liquid crystal display device using an anti-ferroelectric liquid crystal material that also has spontaneous polarization, or a nematic liquid crystal, if it performs color display by a field-sequential method.

Furthermore, while the present invention was explained by taking the liquid crystal display device as an example, it is also possible to apply the present invention in the same manner to other display devices, such as a digital micromirror device (DMD), if they are display devices designed to perform color display by a field-sequential method.

In the present invention, as described above, since data of a predetermined level is added to the pixel data of each emission color inputted according to an image to be displayed and then color display is performed by synchronizing the input of the summed pixel data obtained by the addition with the light emission timing of each emission color, it is possible to increase the brightness of the screen and improve the visibility even in environments with high illuminance such as outdoors, without changing the drive sequence.

In addition, since switching is performed between color display based on the summed pixel data obtained by adding data of a predetermined level to the pixel data of each emission color inputted according to the image to be displayed, and color display based on the pixel data of each emission color inputted according to the image to be displayed, it is possible to convert the pixel data only when there is a need to increase the visibility, and display the image with high color purity when the visibility is sufficient. Since this switching is performed based on ambient illuminance, it is possible to easily adjust the balance between the improvement of visibility and the purity of display colors, according to a need.

Furthermore, regarding the data to be added to the pixel data of each emission color inputted according to the image to be displayed, there are data of a plurality of levels. Since data of one level among the plurality of levels is selected and added to the inputted pixel data of each emission color, it is possible to suitably select a level of data to be added and easily adjust the balance between the improvement of visibility and the purity of display colors. Since this selection is performed based on ambient illuminance, it is possible to easily adjust the balance between the improvement of visibility and the purity of display colors, according to a need.

Besides, since the data to be added to the pixel data of each emission color inputted according to the image to be displayed is substantially white achromatic data, it is possible to prevent a big change in the display colors due to the addition of data.

Moreover, since the intensity of a plurality of emission colors is increased according to a need, it becomes also possible to improve the brightness during white display and achieve a further improvement in visibility.

Additionally, since the level of the pixel data of each emission color inputted according to the image to be displayed is converted and addition data is added to the converted pixel data so that the pixel data after the addition does not exceed a maximum number of gradations, it is possible to prevent white-out of the display and improve the visibility.

Furthermore, since the addition of data is not performed when the level of the pixel data inputted according to the image to be displayed is not more than a predetermined level, it is possible to maintain display with high black/white contrast and achieve an improvement in visibility.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A field-sequential type display device for performing color display by switching a plurality of emission colors of a light source with passage of time and synchronizing light emission timing of each emission color with an input of pixel data of each emission color corresponding to an image to be displayed, comprising:

an adder unit for creating summed pixel data by adding addition data to pixel data of each emission color inputted according to the image to be displayed; and a display unit for receiving an input of the summed pixel data from said adder unit and performing color display by synchronizing the light emission timing of each emission color with the input of the summed pixel data.

2. The display device of claim 1, further comprising a switching unit for performing switching between color display performed based on the pixel data inputted according to the image to be displayed and color display performed based on the summed pixel data obtained by said adder unit.

3. The display device of claim 2, further comprising:

a measuring unit for measuring ambient illuminance; and a control unit for controlling switching performed by said switching unit, based on a result of measurement obtained by said measuring unit.

4. The display device of claim 2, further comprising:

a storage unit for storing a plurality of kinds of data of mutually different levels for use as the addition data; and a selecting unit for selecting one kind of data from the plurality of kinds of data stored by said storage unit.

5. The display device of claim 4, further comprising:

a measuring unit for measuring ambient illuminance; and a control unit for controlling selection performed by said selecting unit, based on a result of measurement obtained by said measuring unit.

6. The display device of claim 2, wherein the addition data is substantially white achromatic data.

7. The display device of claim 2, further comprising an intensity control unit for controlling intensities of the plurality of emission colors of the light source.

8. The display device of claim 2, further comprising a converting unit for creating converted pixel data by converting the inputted pixel data, according to the addition data, wherein the addition data is added to the converted pixel data by said adder unit.

9. The display device of claim 1, further comprising:

a storage unit for storing a plurality of kinds of data of mutually different levels for use as the addition data; and a selecting unit for selecting one kind of data from the plurality of kinds of data stored by said storage unit.

10. The display device of claim 9, further comprising:

a measuring unit for measuring ambient illuminance; and a control unit for controlling selection performed by said selecting unit, based on a result of measurement obtained by said measuring unit.

11. The display device of claim 9, wherein the addition data is substantially white achromatic data.

12. The display device of claim 9, further comprising an intensity control unit for controlling intensities of the plurality of emission colors of the light source.

13. The display device of claim 9, further comprising a converting unit for creating converted pixel data by converting the inputted pixel data, according to the addition data, wherein the addition data is added to the converted pixel data by said adder unit.

14. The display device of claim 1, wherein the addition data is substantially white achromatic data.

15. The display device of claim 1, further comprising an intensity control unit for controlling intensities of the plurality of emission colors of the light source.

16. The display device of claim 1, further comprising a converting unit for creating converted pixel data by converting the inputted pixel data, according to the addition data, wherein the addition data is added to the converted pixel data by said adder unit.

17. The display device of claim 1, further comprising a detecting unit for detecting whether a level of the pixel data to be inputted is not more than a predetermined level, wherein, when the level of the inputted pixel data is not more than the predetermined level, addition of the addition data is not performed by said adder unit.

* * * * *